United States Patent [19]

Tilly et al.

[11] 4,444,121

[45] Apr. 24, 1984

[54] SINGLE WHEELSET RAILWAY TRUCK RIGID TRANSOM CONNECTED SIDEFRAMES

[75] Inventors: Lynn K. Tilly, Hinsdale, Ill.; James M. Kemper, Valparaiso, Ind.

[73] Assignee: AMSTED Industries Incorporated, Chicago, Ill.

[21] Appl. No.: 313,945

[22] Filed: Oct. 22, 1981

[51] Int. Cl.[3] ..... B61F 3/00; B61F 5/24; B61F 5/44

[52] U.S. Cl. ..... 105/165; 105/199 S; 105/206 R; 105/208; 105/224 R; 267/4

[58] Field of Search ..... 105/165, 182 R, 199 S, 105/206 A, 206 R, 224 R, 268, 224 R; 267/4

[56] References Cited

U.S. PATENT DOCUMENTS

| | | | |
|---|---|---|---|
| 2,051,649 | 8/1936 | Delkers | 105/206 R X |
| 2,059,963 | 11/1936 | Barrows | 105/224 R |
| 2,097,579 | 11/1937 | Symington | 105/206 R X |
| 2,235,799 | 3/1941 | Cottrell | 105/206 R |
| 2,961,974 | 11/1960 | Seelig, Jr. | 105/199 S X |
| 4,339,996 | 7/1982 | Brodeur et al. | 105/199 S X |

*Primary Examiner*—Robert B. Reeves
*Assistant Examiner*—Howard Beltran
*Attorney, Agent, or Firm*—Fred P. Kostka; Edward J. Brosius

[57] ABSTRACT

A railroad vehicle truck having a single wheelset includes a pair of spaced side frames. The side frames are joined into a rigid unit by a pair of transversely positioned transom cross bars. The cross bars are positioned one each on each side of the wheelset which has its axle ends journaled in bearings carried in turn in a pedestal jaw centrally formed in each side frame. Projecting inwardly from each end of the side frames is a bracket which forms part of a set of upper pivot connections with an upper end of a swing arm. A laterally positioned crosstie assembly is joined through a pair of spaced end caps with a lower end of each swing arm to form a set of lower pivot connections. Each crosstie assembly end cap has a pair of spring cups containing a set of springs which operatively support a body of the railroad vehicle thereabove.

5 Claims, 9 Drawing Figures

SINGLE WHEELSET RAILWAY TRUCK RIGID TRANSOM CONNECTED SIDEFRAMES

BACKGROUND OF THE INVENTION

1. Field of the Invention

This invention relates to trucks for railroad vehicles and more particularly to a truck having a single wheelset.

2. Prior Art

Traditionally, a truck for use with a railroad vehicle has at least a pair of spaced wheelsets and is commonly referred to as "a 4-wheel truck". Each wheelset comprises two wheels joined to a free axle wherein the wheels and respective axle rotate as a unit. Such trucks were developed to support considerable loads and today are available with rated capacities of 100 tons or greater.

When the railroad vehicle is not required to carry such heavy loads, for example in passenger service or piggy-back type service of automotive trailers or containers, then the load carrying capacity of the truck may be reduced substantially.

One suggested railroad vehicle truck particularly adapted for lighter loads includes a single wheelset. The wheelset has its axle ends rotatively journaled in bearings. The bearings in turn operatively connect through an adapter to a centrally located pedestal jaw integrally formed as part of each of a pair of spaced longitudinally positioned side frames.

At each side frame end is an inwardly projecting bracket which in turn pivotally supports an upper end of a swing arm. Positioned laterally between the front and rear swing arm pairs is a crosstie assembly. Each assembly has a pair of end caps which pivotally connect respectively with a lower end of each swing arm pair.

Because the upper side frame bracket-swing arm pivot connections are located apart at a lesser distance than the lower crosstie assembly end cap-swing arm pivot connections, the crosstie assembly is self-leveling. Each crosstie assembly end cap has a pair of cups which contain lower ends of set of springs. Upper ends of the spring sets are operatively connected to a body of the railroad vehicle and resiliently support such.

The railroad truck as described above in theory provides certain advantages over the traditional 4-wheel truck. First, the mass of the truck is reduced. This lesser mass between the track and the car body reduces track wear and reduces the energy required to move the railroad vehicle body associated with the truck. This mass can be further minimized by using components having an optimum strength-to-weight ratio.

The railroad vehicle truck as described, however, has not been built and tested to prove its ability to operate satisfactorily in the harsh environment of railroading. To evaluate the structural integrity of the design prior to actual fabrication and field testing, the various components were studied using computerized finite element analysis. This analysis revealed that the initial design of the side frames and crosstie end caps could be expected to fail when subjected to static and dynamic forces which the truck would typically encounter during use.

SUMMARY OF THE INVENTION

According to this invention there is provided an improved truck for a railroad vehicle; the truck has a pair of spaced side frames with each side frame having an elongated hollow configuration. Within the side frame is a pair of spaced inner partial ribs located above a roof on a centrally located pedestal jaw formed as part of the side frame and including end portions extending downwardly therefrom; a pair of spaced intermediate ribs located respectively above the end portions of the pedestal jaw, and a pair of spaced outer ribs located respectfully between access openings formed in an inner and outer side wall of the side frame and end walls of the side frame with each inner access opening being located in a raised position formed in the inner side wall; the raised portions join the pair of outer ribs respectively with each outer rib being aligned with a boss formed on each raised portion.

The invention may be further provided to include each inner rib having a downwardly facing convex shaped bottom edge, each intermediate rib being provided with an oblong shaped opening and each outer rib having a round opening. Additionally, the end wall includes a square shaped opening with the end wall and outer side wall joining to form radiused corner having a thickness substantially equal to a thickness of the outer side wall.

This invention produces certain improved results. To appreciate these improved results it should be understood that a structurally sound side frame is provided by insuring that no portion of the side frame is stressed beyond a yield point of that particular side frame portion. Preferably all levels of stress within the side frame are maintained sufficiently below the yield point to afford a reasonable margin of safety. The level of such stress is directly proportional to the magnitude of the force applied to the side frame and is indirectly proportional to the physical configuration of the particular side frame portion. The magnitude of the force applied to the side frame cannot be readily changed without a major modification to the design of the truck. On the other hand, a mere increase in the mass of the side frame is contra to the objective of minimizing the mass of the truck.

The structural element as described above optimizes the side frame in that the side frame is structurally sound and the mass is a minimum.

DESCRIPTION OF THE PREFERRED EMBODIMENT

Figure 1:
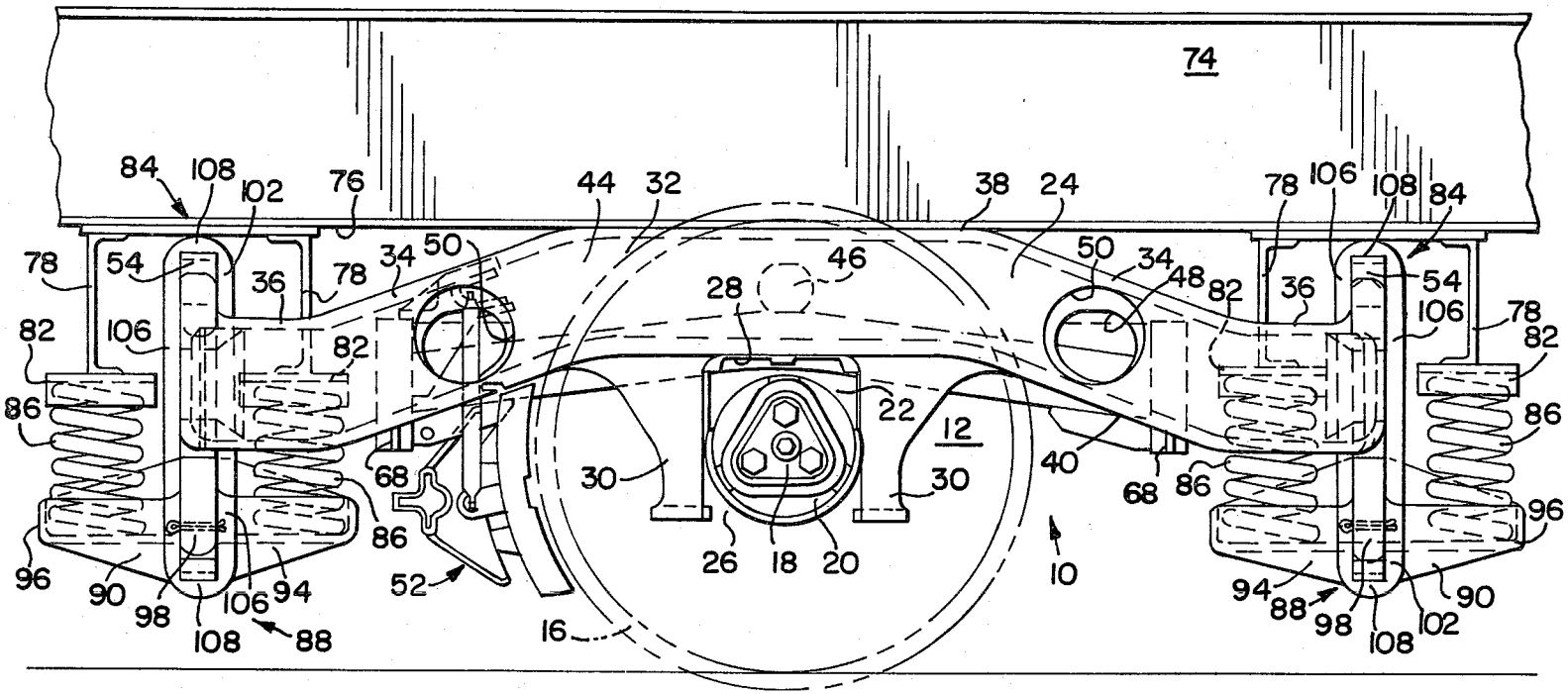
FIG. 1 is a side elevation view of a railroad car truck incorporating this invention.
Figure 2:
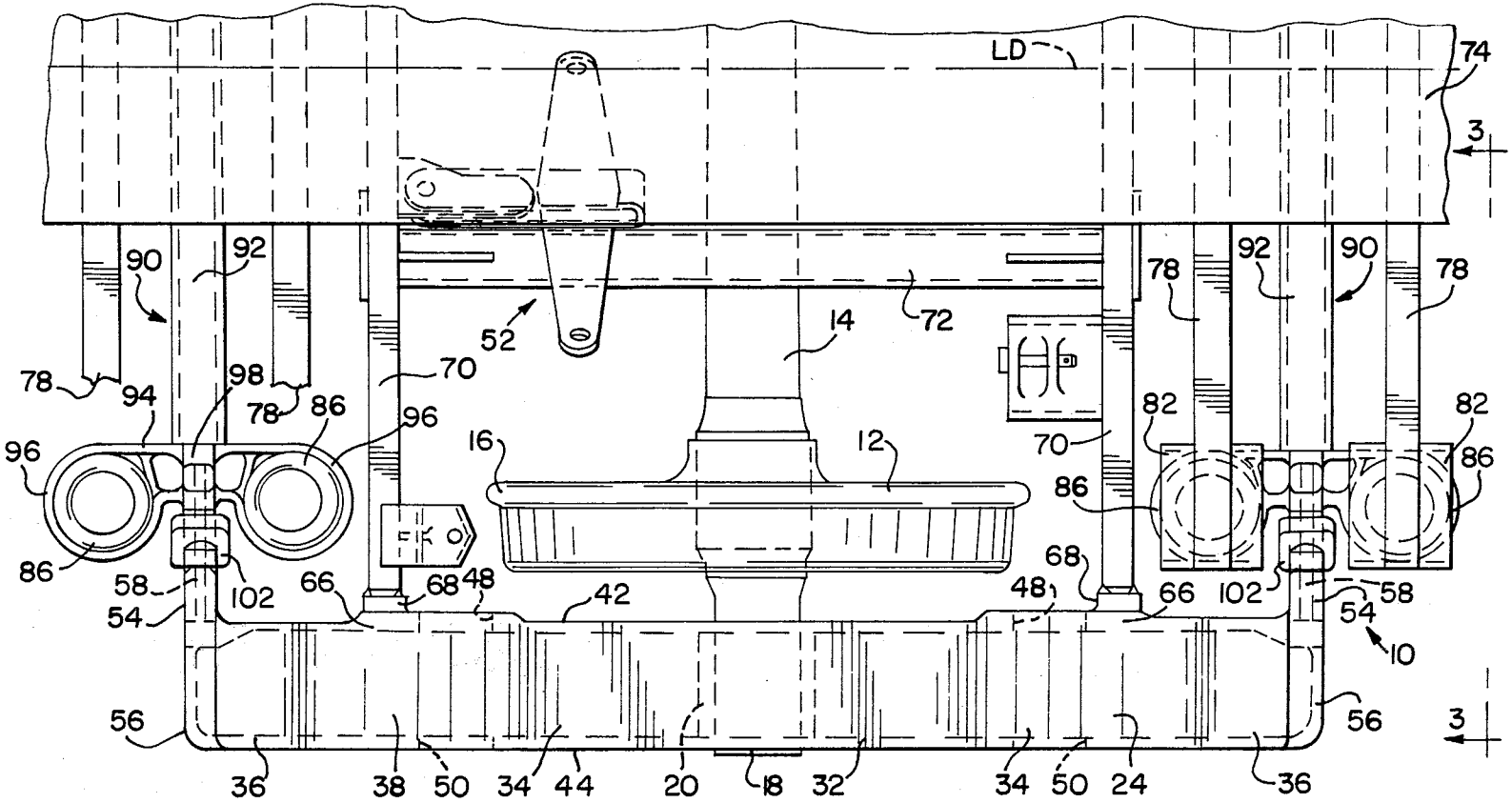
FIG. 2 is a partial plan view of the truck of FIG. 1 with a selective upper portion of the truck cutaway.
Figure 3:
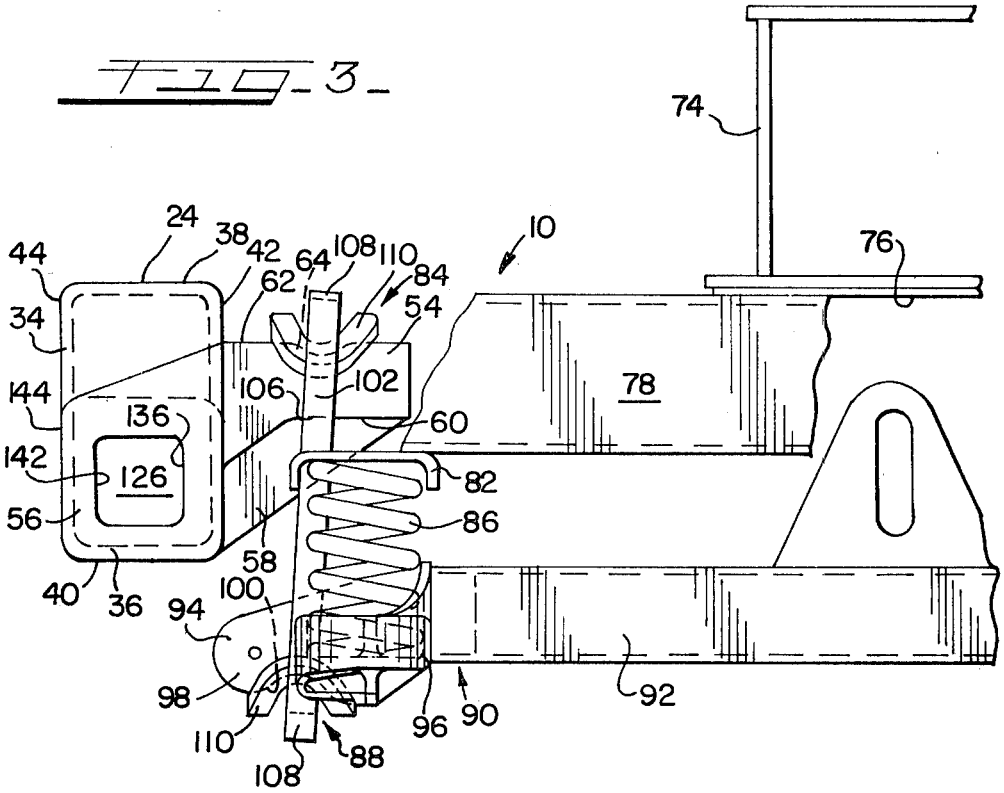
FIG. 3 is an end elevation view as seen generally along the line 3—3 of FIG. 2 with a selective portion of the truck cutaway.

A railroad car truck incorporating this invention is shown generally in FIGS. 1–3 and designated 10. The truck 10 includes a wheelset 12 comprising a free axle 14 with a pair of spaced wheels attached thereto. Only one such wheel 16 is shown in FIG. 2. The structure of the truck 10 is symmetrical with respect to its longitudinal axis LD and therefore only one-half of the truck 10 is shown.

Figure 9:
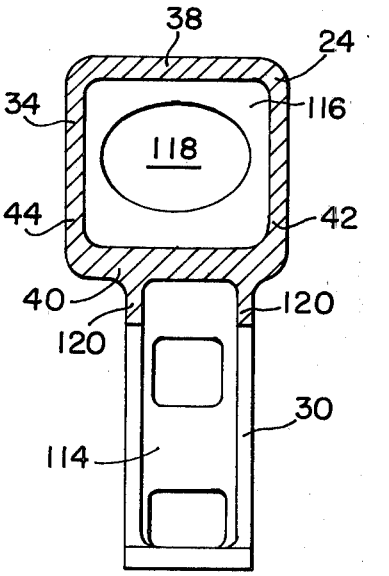
FIG. 9 is a further cross section elevation view of the side frame as seen generally along the line 9—9 of FIG. 4.

An axle end 18 of the wheelset 12 is journaled in a bearing 20 in a known manner. An adapter 22 operatively connects the axle end 18 and the bearing 20 to a side frame 24. The adapter 22 is positioned within a pedestal jaw 26 defined by a flat roof 28 and spaced end portions 30. The pedestal jaw roof 28 and end portions 30 are formed as an integral part of the side frame 24. Note that the vertical axis of the pedestal jaw 26 is inwardly offset from a vertical axis of the side frame 24, see FIGS. 6, 9.

The side frame 24 has a gull wing-like configuration defined by a upper middle portion 32 which is joined at each end by downwardly sloped intermediate portions 34. Ends of the sloped intermediate portions 34 in turn connect with lower outer portions 36. The side frame 24 has a generally hollow cross section configuration, see FIG. 4, comprising a top and bottom wall 38, 40 joined by spaced inner and outer side walls 42, 44. Centrally located in the inner side walls 42 is an elliptical shaped opening 46. Also in each side wall 42, 44 and located in each side frame intermediate portion 34 is an inner opening 48 having an oblong configuration and an outer opening 50 which has a round configuration. The openings 48, 50 provide access to brake rigging shown generally and designated 52.

Figure 6:
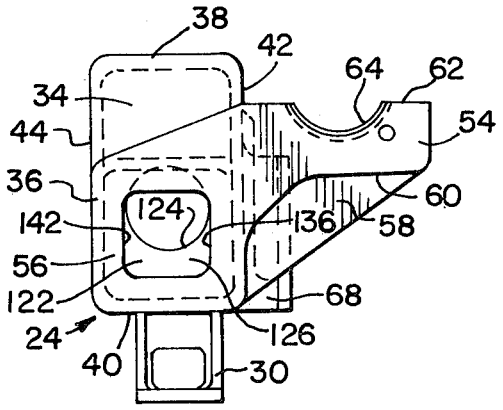
FIG. 6 is an end elevation view of the side frame as seen generally along the line 6—6 of FIG. 4.
Figure 5:
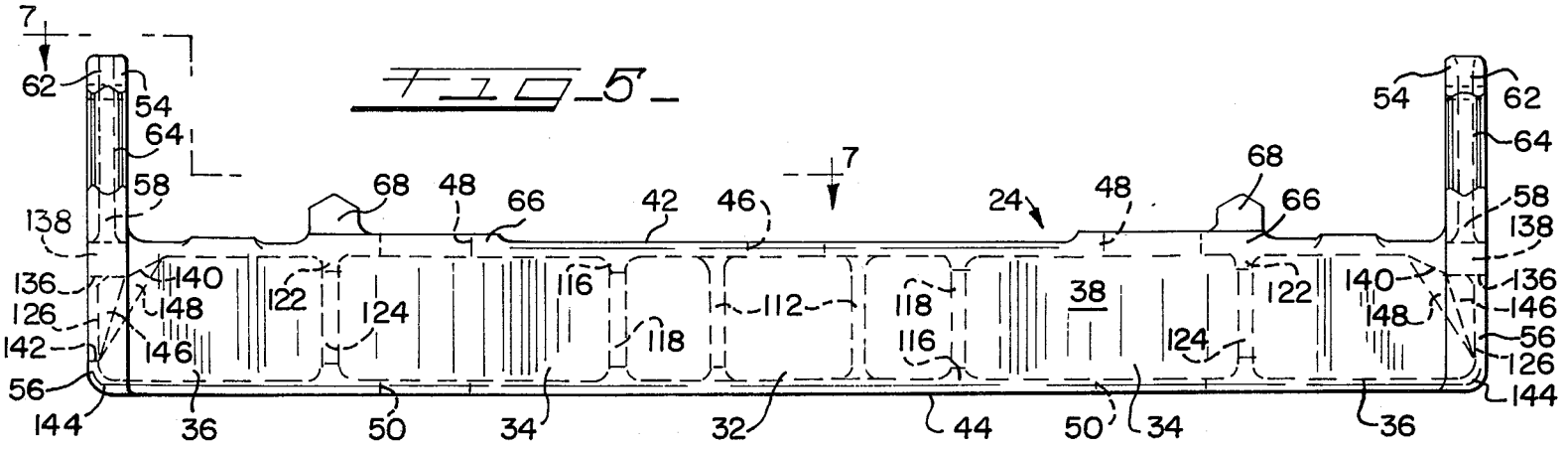
FIG. 5 is a top plane view of the side frame as seen generally along the line 5—5 of FIG. 4.

As best seen in FIGS. 3, 5, and 6, projecting inwardly from an end of each side frame outer portion 36 is a bracket 54 having an offset configuration. The bracket 54 is formed as an integral part of an end wall 56 of the side frame 24 and includes a vertical reinforcing rib 58. The rib 58 joins a bottom surface 60 of the bracket 54 and the inner side wall 42 of the side frame 24. A top surface 62 of each bracket 54 is formed with a radiused groove 64, see FIG. 6.

On the inner sidewall 42 of the side frame 24 is a pair of spaced raised portions 66 which extend about each inner opening 48 and include a rectangular shaped boss 68. Attached to each boss 68 is an end of a transom cross bar 70, see FIG. 2. It should be understood that the cross bars 70 extend laterally across the truck 10 with an opposite end of each connecting with like boss formed on the other side frame (not shown). The cross bars 70 join the side frames into the rigid unit. To provide further stiffness, a pair of longitudinal bracing members connect the cross bars 70 with one such member 72 shown in FIG. 2.

A body of the railroad vehicle (now shown in detail) may include a longitudinal underframing support 74 shown in FIGS. 1 and 3. Affixed to a bottom surface 76 of the support 74 are two pairs of laterally positioned channels 78. Attached to an outer end of each pair of channels 78 is a pair of upper spring cups 82 which contain upper ends of a set of coil springs 86.

Positioned laterally on each side of the wheelset 12 is a crosstie assembly 90. Each crosstie assembly 90 comprises a middle tubular portion 92 having its ends joined to spaced end caps 94. Each end cap 94 is formed with a pair of spring cups 96 which in turn loosely hold lower ends of the set of springs 86. Positioned between the spring cups 96 and attached thereto is a center block 98. The center block 98 is formed with a downward facing radiused groove 100, see FIG. 3.

Each crosstie assembly 90 is operatively connected to the side frames by a pair of swing arms, and in FIGS. 1 and 2 for example, two of the four swing arms are shown and designated 102. Each swing arm 102 has an elongated loop-like configuration defined by a pair of straps 106 which are joined together by upper and lower cross pieces 108. Each cross piece 108 forms a seat for a bushing 110, see FIG. 3, which interfaces between the side frame bracket radiused groove 64 and the crosstie assembly end cap radiused groove 100 to form an upper and lower pivot connection 84, 88. These pivot connections 84, 88 allow the crosstie assemblies 90 to swing laterally to accommodate like movements of the body of the railroad vehicle. Note that the upper pivot connections 84 are inwardly offset from the lower pivot connections 88. This offset produces a self-leveling effect to dampen the swing action of the crosstie assemblies 90 transferred from like movements of the railroad vehicle body during travel thereof.

To best understand the construction of the side frame 24, it is suggested that FIGS. 4–9 be viewed concurrently with the written description below.

The top and bottom walls 38, 40 of the side frame middle upper portion are generally horizontal with the bottom wall 40 being proximately 50 percent thicker than the top wall i.e. 1 3/16 in. v., $\frac{3}{4}$ in. thick. This greater thickness provides the bottom wall 40 with the necessary flexible strength for transferring dynamic and static loads between the wheelset 12 and the body of the railroad vehicle thereabove. Note that the bottom surface of this bottom wall portion serves as the roof 28 of the pedestal jaw 26. The end portions 30 of the pedestal jaw 26 are formed integrally with and extend downward from the side frame bottom wall 40.

The bottom wall 40 in the side frame sloped intermediate portion 34 also are made with this increased thickness while the bottom wall 40 of each outer end portion 36 has a reduced thickness proximating $\frac{5}{8}$ in., for example. The top wall 38 of each sloped intermediate portion 34 is also made to this increased thickness while the top wall 38 of each outer end portion 36 has a reduced thickness of, for example, $\frac{5}{8}$ in.

Within the side frame middle upper portion 32 and integrally joined to the top wall 38 and the side walls 42, 44 are a pair of partial inner ribs 112. The partial inner ribs 112 are located one each equidistant on each side of a center of the side frame 24. Each rib 112 is in proximate vertical alignment with an inner web member 114 of each pedestal jaw end portion 30. Each rib 112 has a downward facing concave shaped bottom edge 115, see FIG. 8. Also within the side frame middle upper portion 32 and integrally joined to the top and bottom walls 38, 40 and the inner and outer side walls 42, 44 are a pair of intermediate ribs 116. The intermediate ribs 116 are also located one each equidistant one each side of the center of the side frame 24. Each intermediate rib 116 is formed with a substantially centrally located elliptically shaped opening 118, see FIG. 9. A major axis of the opening 118 is horizontal. Each intermediate rib 116 is located above outer ends of spaced flange member 120 which joined the inner web member 114 to form the pedestal jaw end portions 30.

Lastly, there are a pair of outer ribs 122 located within the side frame sloped intermediate portions 34. The outer ribs 122 are integrally joined to the side frame top and bottom walls 38, 40 and the inner and outer side walls 42, 44. Each outer rib 122 is located an equidistant on each side of the side frame center and are in substantially horizontal alignment with the bosses 68 respectively. Each outer rib 122 is formed with a circular shaped opening 124 best seen in FIG. 6.

Figure 4:
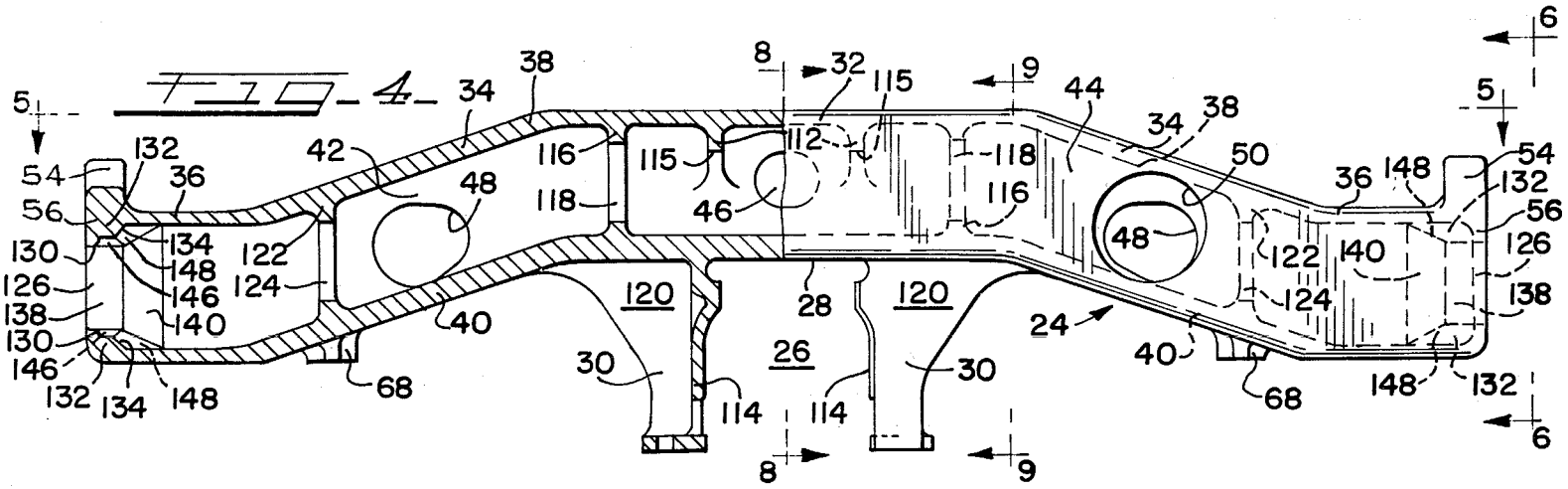
FIG. 4 is a side elevation view partially in section of a side frame of the truck of FIG. 1.
Figure 7:
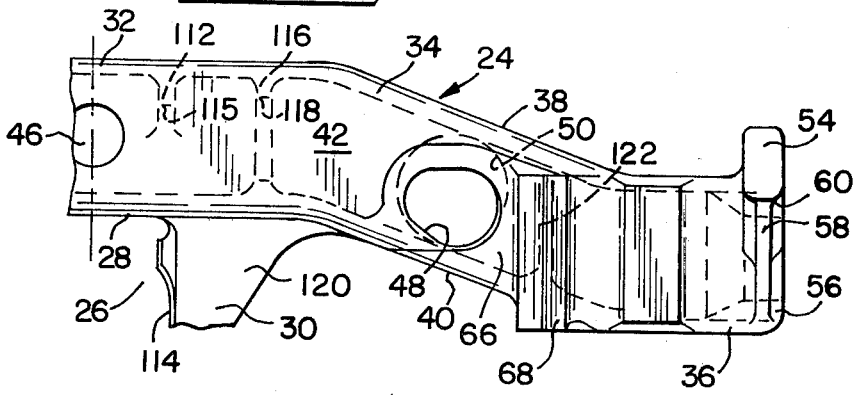
FIG. 7 is a side elevation view of the side frame as seen generally along the line 7—7 of FIG. 5.
Figure 8:
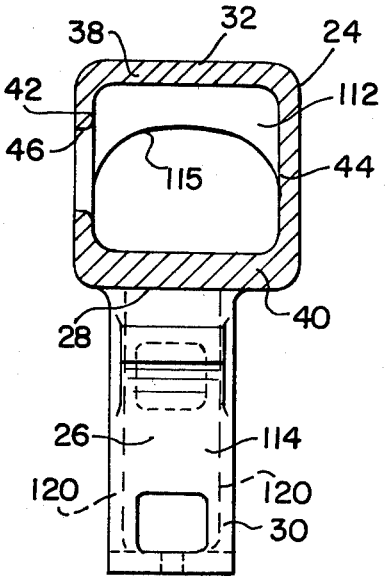
FIG. 8 is a cross section elevation view of the side frame as seen generally along the line 8—8 of FIG. 4.

Each side frame end wall 56 has a square shaped opening 126 defined in part by a top and bottom lip 130, see FIG. 4. The top and bottom lips 130 join a top and bottom segment 132. The top and bottom segments 132 each have a tapered inner face 134 which merge with the top and bottom wall 38, 40 respectively. An inner vertical edge 136 of the end wall opening 126 in turn joins an inner side wall segment 138. The segment 138 has a tapered inner face 140 which merges with the side frame inner side wall 42. An outer vertical edge 142 of the end wall opening 126 joins with a thinned vertical corner section 144 which in turn merges with the side frame outer side wall 44. Because the outer side wall 42 at the corner section 144 is thin while the top and bottom segments 132 and inner side wall segments 138 are substantially thicker, a pair of upper and lower triangular shaped surfaces 146, 148 are inwardly, and upwardly and downwardly formed.

During operation of the railroad vehicle which would include a set of the trucks 10 located one each at respective end of the vehicle, each truck 10 is subjected to dynamic and static forces. These forces are multidirectional in nature and produce shear, bending, tensile, compressive and torsional stresses in the various truck component.

One force which is substantially vertical in direction comprises a static component generated from a weight of the vehicle body and its related load. The other component of this vertical force is dynamic in nature and results from changes in the absolute and relative vertical location of the truck 10 and the vehicle body.

Also during travel of the railroad vehicle the railroad vehicle body rolls and pitches in response to changes in velosity and changes in direction, for example, about a curved section of track. Such rolling movements are translated in part into a sideway swinging or lateral oscillating movement of the vehicle body. These movements and related dynamic forces are transferred by the springs 86 to the crosstie assemblies 90 which may swing as provided by the upper and lower pivot connections 84, 88 between the side frame brackets 54, the swing arms 102 and the crosstie assemblies 90 respectively. These rolling related forces also increase and decrease the dynamic component of the vertical force depending on the relative position of the crosstie assemblies as they swing from side-to-side.

All of these forces as noted are transferred by the crosstie assemblies 90 to the side frames 24 by the swing arms 102. The side frames 24 in turn transfer such to the wheelset 12. Note the points at which these forces are transferred i.e. lines of force, from the swing arms 102 to the side frames 24 are at the upper pivots 84. On the other, the effective point of transfer i.e. line of force between the side frame 24 and the wheelset 12 is the side frame pedestal jaw 26.

These lines of force are spaced apart longitudinally and laterally. The longitudinal spacing creates a force moment which produces bending stresses in the side frame 24. On the other hand, the lateral spacing creates a force moment which produces torsional or twisting stresses in the side frame 24. Note, however, that twisting of the side frame 24 is substantially limited to the lower outer end portions 36 because of the transom cross bars 70 resist any twisting of the sloped intermediate portions 34 and middle upper portion 32. Within the inner side wall 42 and top and bottom walls 38, 40 the twisting forces and bending forces are in the same direction and thus accumulate to produce high levels of stress. Within the side frame outer side wall 36 the stress is at a reduced level because the twisting forces tend to cancel the bending forces being in the opposite direction. The accumulative bending and twisting forces are particularly accommodated by the raised portions 66 in the inner side wall 42 which join with the thickened top and bottom wall. Additional strength is provided by the outer ribs 122 which are aligned with the transom cross bars 70 to provide a continuous section between side frame outer side walls 44. The inner openings 48 weaken the inner side wall 44. However, the oblong configuration of each opening 48 minimizes this weakening effect. Lastly, the bottom wall 40 in the side frame middle upper portion 32 is subjected to localized stresses as the bottom wall 40 also serves as the pedestal jaw roof 28. These localized stresses are accommodated by providing a free area above the bottom wall 40 in line with the pedestal jaw roof 28. Note that the inner ribs 112 add substantial strength to this free area in the side frame middle upper portion 32 while allowing the bottom member 40 to flex as it engages with the adapter 22. The outer ends of the pedestal jaw end portion 30 and respective side frame portions are substantially strengthened by the intermediate ribs 116. Note also that the inner and intermediate ribs 114, 116 are useful to offset the torsional effect resulting from the pedestal jaw 26 being offset with respect to the body portion of the side frame 24.

While various modifications may be suggested by those versed in the art, it should be understood that we wish to embody within the scope of the patent warranted hereon all such modifications as reasonably and properly come within the scope of my contribution to the art.

What is claimed is:

1. A side frame particularly adapted for use in a railroad car truck having a single wheelset, said side frame comprising, a hollow, elongated body defined by spaced inner and outer side walls joined together by a top and bottom wall, a bracket at each end of said body extending inwardly from end walls on said body, said inner side wall formed with a pair of oblong shaped openings in spaced, sloped intermediate portions of said side frame to provide access to brake rigging of said truck, and a pair of outer ribs formed within said body and integrally joined to said side walls and said top and bottom wall, one each of said pair of ribs located between said opening and said bracket respectively with each of said ribs in substantial alignment with a respective one of longitudinally spaced transom cross bars joining a pair of said side frames into a rigid unit.

2. A side frame as defined in claim 1 and further characterized by, said oblong openings one of said pair being formed in each of a pair of spaced raised portions in said side frame inner side wall with said raised portions extending toward said end walls to interface respectively between said outer ribs and a boss projecting from each said raised portion for connecting one each with ends of said transom cross bars.

3. A side frame as defined by claim 1 and further characterized by, a pair of spaced partial ribs formed within said body and integrally joined to said side walls and said top wall of an upper middle portion of said side frame with one each of said inner ribs located equidistant from a center of said side frame and in proximate vertical alignment with an inner web member of pedestal jaw end portions joined to and extending downward from said side frame bottom wall.

4. A side frame as defined in claim 3 and further characterized by, a pair of spaced intermediate ribs formed within said body and integrally joined to said side walls and said top and bottom wall with one each of said intermediate ribs located equidistant from said side frame center and in proximate vertical alignment with an outer end of each said pedestal jaw end portion.

5. A side frame particularly adapted for use with a single wheelset, said side frame comprising, an elongated, hollow tubular body defined by an inner and outer side wall joined together by a top and a bottom wall with spaced end portions joined to said bottom wall to define in part a pedestal jaw to receive an axle end to said wheelset, a pair of partial inner rib means located so that one of each is equidistant on each side of a center of said side frame and in substantial vertical alignment with an inner web member of each said pedestal jaw end portion, each of said inner rib means being integrally joined to an inside of said frame top wall and side walls, a pair of intermediate rib means located one each equidistant on each side of said side frame center and in proximate vertical alignment with an outer end of said pedestal jaw end portions, each intermediate rib means joined to said inside of said side frame top and bottom wall and said side walls, a pair of spaced raised portions formed as part of said side frame inner side wall, said raised portions positioned between said intermediate rib means and end walls of said side frame respectively with each said raised portion having an oblong-like shaped opening therein, and a pair of spaced outer rib means located one each between said openings and said end walls respectively in substantial alignment with a transom cross bar joined to said inner side wall, each said outer rib means integrally joined to said inside of said side frame top and bottom wall and said side walls, wherein said rib means transfer torsion and bending forces from said inner side wall to reduce an accumulation effect of said forces therein.

* * * * *